US009672681B2

(12) United States Patent
Du et al.

(10) Patent No.: US 9,672,681 B2
(45) Date of Patent: Jun. 6, 2017

(54) METHOD AND SYSTEM FOR SELF-SERVICE EQUIPMENT OUTPUTTING AND COLLECTING MONEY

(71) Applicant: GRG Banking Equipment Co., Ltd., Guangzhou, Guangdong (CN)

(72) Inventors: Gaofeng Du, Guangzhou (CN); Qinghua Wang, Guangzhou (CN); Yangshuai Fan, Guangzhou (CN); Qunwei Ning, Guangzhou (CN); Zhuming Xiao, Guangzhou (CN)

(73) Assignee: GRG Banking Equipment Co., Ltd., Guangzhou, Guangdong ( * ) Notice: Subject to any disclaimer, the term of this patent is extended or adjusted under 35 U.S.C. 154(b) by 0 days.

(21) Appl. No.: 14/649,020

(22) PCT Filed: Jul. 8, 2013

(86) PCT No.: PCT/CN2013/078972
§ 371 (c)(1),
(2) Date: Jun. 2, 2015

(87) PCT Pub. No.: WO2014/089964
PCT Pub. Date: Jun. 19, 2014

(65) Prior Publication Data

US 2015/0317859 A1 Nov. 5, 2015

(30) Foreign Application Priority Data

Dec. 11, 2012 (CN) ..... 2012 1 0534777

(51) Int. Cl.
*G07D 11/00* (2006.01)

(52) U.S. Cl.
CPC ..... *G07D 11/0051* (2013.01); *G07D 11/0063* (2013.01)

(58) Field of Classification Search
CPC ..... G07D 11/0051; G07D 11/0063; G07D 11/006
See application file for complete search history.

(56) References Cited

U.S. PATENT DOCUMENTS 5,247,159 A 9/1993 Yuge et al.
7,000,778 B2 2/2006 Omori et al.
(Continued)

FOREIGN PATENT DOCUMENTS

CN 101510328 A 8/2009
CN 201397535 Y 2/2010
(Continued)

OTHER PUBLICATIONS

Written Opinion of the International Authority, dated Aug. 29, 2013, from corresponding International Application No. PCT/CN2013/078972.
(Continued)

*Primary Examiner* — Kristy A Haupt
(74) *Attorney, Agent, or Firm* — Wolf, Greenfield & Sacks, P.C.

(57) ABSTRACT

A method and system for self-service equipment outputting and collecting money. A money box of self-service equipment is provided with two money box statuses which are a functional status and a collecting status. Under the functional status, the money box implements a money storage function used generally in a common situation. When a collecting box is full or in an abnormal status, some money box is chosen and set to switch from the functional status into the collecting status and to act as a temporary collecting box. So the technical problem that the self-service equipment cannot continuously provide cash services when the collecting box or a box for cash no longer fit for circulation is full is solved, the self-service equipment can continuously provide the cash service, that is, money depositing and
(Continued)

withdrawing service, under the condition that the collecting box is full, and the starting-up rate of the self-service equipment is improved.

9 Claims, 5 Drawing Sheets

(56) References Cited

U.S. PATENT DOCUMENTS

| | | | | |
|---|---|---|---|---|
| 2003/0015395 | A1 | 1/2003 | Hallowell et al. | |
| 2005/0056519 | A1 | 3/2005 | Yokoi et al. | |
| 2012/0125734 | A1* | 5/2012 | Okamura ..... | G07D 11/006 194/216 |

FOREIGN PATENT DOCUMENTS

| | | | |
|---|---|---|---|
| CN | 101847288 | A | 9/2010 |
| CN | 102637319 | A | 8/2012 |
| CN | 103065387 | A | 4/2013 |
| JP | H11102457 | A | 4/1999 |
| WO | WO 2012164620 | A1 | 12/2012 |

OTHER PUBLICATIONS

International Search Report dated Aug. 29, 2013 from corresponding International Application No. PCT/CN2013/078972.
Extended European Search Report, dated Nov. 10, 2015, from corresponding European Application No. 13862067.9.
Chilean Office Action, dated Dec. 18, 2015, from corresponding Chilean Patent Application No. 2015-001576.

* cited by examiner

METHOD AND SYSTEM FOR SELF-SERVICE EQUIPMENT OUTPUTTING AND COLLECTING MONEY

This application is the national phase of International Application No. PCT/CN2013/078972, filed on Jul. 8, 2013, which claims the priority benefit of Chinese Patent Application No. 201210534777.7 titled "METHOD AND SYSTEM FOR SELF-SERVICE EQUIPMENT OUTPUTTING AND COLLECTING MONEY", filed with the Chinese State Intellectual Property Office on Dec. 11, 2012, which applications are hereby incorporated by reference to the maximum extent allowable by law.

FIELD

The present disclosure relates to the field of financial self-service equipment, and particularly to a method and system for outputting and collecting money applied to self-service equipment.

BACKGROUND

At present, for the self-service equipment outputting money technology, the self-service equipment is equipped with only one collecting box/waste box (hereinafter collectively referred to as the collecting box). The self-service equipment cannot output money in the case that the collecting box is full or abnormal, and thus cash service cannot be continued. The self-service device cannot perform normal cash service until a maintainer clears and empties the collecting box. Accordingly, the collecting box may be considered as a bottleneck for the self-service, and the cash service cannot be performed once the collecting box is broken. In the case that there is a technology to address this bottleneck defect, that is, the cash service may be continued in the case that the collecting box is full, then the utilization efficiency and the starting-up rate of the self-service equipment may be improved, the benefit of the self-service equipment may be increased, and it is convenient for self-service users to use it.

SUMMARY

To solve the above-described problem, a method for outputting and collecting money applied to self-service equipment is provided according to the present disclosure. The self-service equipment can still continue outputting and collecting money in the case that a collecting box is full, the equipment will not stop operating due to an event that the collecting box is full, and thus the self-service may not be suspended.

Another object of the present disclosure is to provide a system for outputting and collecting money applied to self-service equipment which is capable of implementing the above-mentioned method.

The object of the present disclosure is realized as follows. A method for outputting and collecting money applied to self-service equipment is provided, in which money boxes of the self-service equipment have two statuses including a functional status and a collecting status; under the functional status, the money box performs a function of storing money in a common situation; and when a collecting box becomes full or abnormal, a certain one of the money boxes is selected and switched from the functional status to the collecting status to act as a temporary collecting box.

The method for outputting and collecting money applied to self-service equipment includes the following sequential steps:

(1) stopping temporarily a function of normal self-service cash service when a dedicated collecting box and a waste money box become full;

(2) selecting one appropriate money box from all functional money boxes to act as one collecting box;

(3) proceeding to step (4) in the case that the selected money box is empty, or separating normal money in the case that the normal money exists in the money box;

(4) labeling the money box as the collecting box and notifying an upper service software;

(5) configuring the money box to be a temporary collecting box; and (6) restoring the function of normal self-service cash service, and performing money collecting processing in the self-service process by using the temporary collecting box.

A system for outputting and collecting money applied to self-service equipment is provided, which includes the following modules:

(1) a self-service serving module, configured to provide software and hardware devices for the self-service;

(2) a dedicated collecting box being full or abnormal event monitoring module, configured to learn an event that the dedicated collecting box is full or fails in time and report the event to the self-service serving module in the case that the dedicated collecting box becomes full or fails;

(3) a money box status determining module, configured to determine whether the money box is full or empty, or whether money is too less;

(4) a temporary collecting box selection module, configured to search for an appropriate money box to act as the temporary collection box in the case that the dedicated collection box is full or fails; and (5) a temporary collecting box setting module, configured to set a money box to act as the temporary collection box for accommodating the collected money in the case that the dedicated collection box is full or fails.

The dedicated collecting box being full or abnormal event monitoring module transmits an event signal to the self-service serving module once it is found that the dedicated collecting box fails to service normally, and the self-service serving module suspends the cash service; the self-service serving module notifies the money box status determining module to determine the status of each functional money box and a money box of which the remaining space meets the space requirement for the collecting box is selected to act as the temporary collecting box among all money boxes in the self-service equipment except a money box having stuck money based on a type of the self-service equipment and a preset selection policy; the temporary collecting box setting module performs a setting of temporary collecting box on the selected money box, separates the normal money in the money box, and sets the functional money box as the temporary collection box for accommodating the collected money in the subsequent self-service cash service; the temporary collecting box setting module sets the selected money box as the temporary collecting box, makes the dedicated collecting box quit the self-service, and transmits an event to notify the self-service serving module upon completion of the setting; and the self-service serving module provides the cash service again, and uses the temporary collecting box to accommodate the collected money in service.

Compared with the conventional art, according to the present disclosure, it is solved the technical problem that the self-service equipment cannot continue to provide the cash service in the case that the collecting box or the waste money box is full, therefore, the self-service equipment can continue providing the cash service, namely money depositing and withdrawing service, in the case that the collecting box is full, and the starting-up rate of the self-service equipment is improved.

DETAILED DESCRIPTION

A method for outputting and collecting money applied to self-service equipment is provided according to the present disclosure. Specifically, money boxes of the self-service equipment (all functional money boxes including a Cash In/out Equipment, an Automatic Teller Equipment or a Cash Deposit Equipment, and the like) have two statuses including a functional status and a collecting status; under the functional status, the money box performs a function of storing money in a common situation; and when a collecting box becomes full or abnormal, a certain one of the money boxes is selected and switched to the collecting status to act as a temporary collecting box. When any one of the money boxes of the self-service equipment becomes empty or a certain one of the money boxes of the self-service equipment has a small amount of money, the money box is selected and set to enter the collecting status to act as the temporary collecting box. In the case that normal money exists in the money box acting as the temporary collecting box, automatic isolation is performed, that is, the normal money in the money box is retained in the money box, the normal money is isolated into a back end part of the money box by using a physical device, and a front end part is separated for accommodating collected money and waste money; or all money in the money box is removed and stored into a money box storing money of the same denomination, and the money box is spared to act as the temporary collecting box, the money box is automatically labeled as the collecting box, and thereby it is convenient for a maintainer to clear and maintain the money box.

Figure 1:
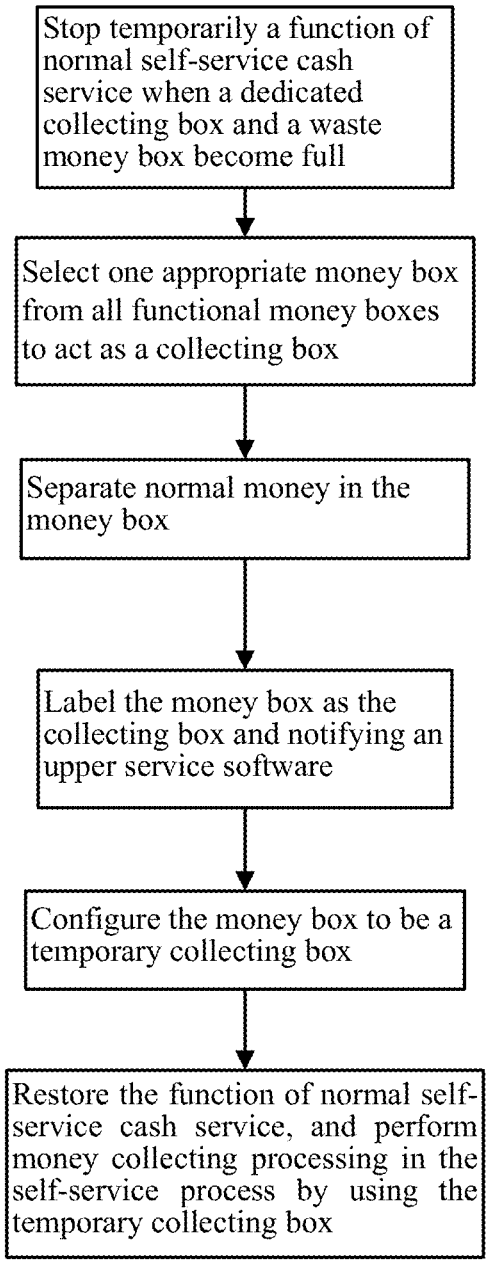
FIG. 1 is a flow chart of a method for outputting and collecting money applied to self-service equipment according to the present disclosure.

As shown in FIG. 1, the method for outputting and collecting money applied to self-service equipment includes the following sequential steps:

(1) stopping temporarily a function of normal self-service cash service when a dedicated collecting box and a waste money box become full;

(2) selecting one appropriate money box from all functional money boxes to act as a collecting box;

(3) proceeding to step (4) in the case that the selected money box is empty, or separating normal money in the case that the normal money exists in the selected money box;

(4) labeling the selected money box as the collecting box and notifying an upper service software;

(5) configuring the selected money box to be a temporary collecting box; and (6) restoring the function of normal self-service cash service, and performing money collecting processing in the self-service process by using the temporary collecting box.

The process of searching for an appropriate money box to act as a temporary collecting box in step (2) includes: firstly, determining whether the self-service equipment is a Cash In/out Equipment, an Automatic Teller Equipment or a Cash Deposit Equipment, and then selecting a most appropriate money box to act as the temporary collecting box based on the obtained type of the self-service equipment, according to a preset selection policy in Table 1.

TABLE 1

| No. | Type | Selection policy for temporary money box | Introduction |
|---|---|---|---|
| 1 | Cash In/out Equipment | Principle: to ensure that the selected money box have enough remaining space to meet a requirement for the temporary collecting box, a money box having the least amount of money among money boxes for a same denomination is optimum, while a money box making a money of a certain denomination inoperable is the worst. The selection process is as follows:<br>selecting one money box in the case that there are multiple money boxes for a uncommon denomination; or else proceeding to step 2).<br>selecting one money box in the case that there are multiple money boxes for a common denomination; or else proceeding to step 3).<br>3) selecting a money box for a uncommon denomination, and stopping collecting money for the denomination. | No matter how big remaining total space of a certain denomination is, all existing denominations should be kept operable. In the case that a money box for a certain denomination is full, a normal depositing operation for this denomination cannot be restored until a withdrawing user removes a part of money; in the case that all money for a certain denomination is taken out, a normal withdrawing operation for this denomination cannot be restored until a depositing user stores |

TABLE 1-continued

| No. | Type | Selection policy for temporary money box | Introduction |
|---|---|---|---|
| | | | a part of money; in the case that the selected money box is ensured to have enough remaining space. |
| 2 | Cash Deposit Equipment | Principle: to ensure that the selected money box has enough remaining space to meet a requirement for the temporary collecting box, a policy of making remaining total space for the common denomination largest is optimum; a money box having a certain remaining space among money boxes for a same uncommon denomination is second best. | Remaining total space for common denomination is made biggest, it may be ensured that more depositing service is normal, and uncommon denomination may be rejected. |
| 3 | Automatic Teller Equipment | To ensure that the selected money box have enough remaining space to meet a requirement for the temporary collecting box, an empty money box is optimum; a money box having the least amount of remaining money among money boxes for a same denomination is second best; and a money box having the least amount of the remaining money is third best. | The empty money box is inoperable since there is no normal money in this money box. There is no need to remove and separate the normal money in the money box, and the money box may act as a temporary collecting box. |

Figure 2:
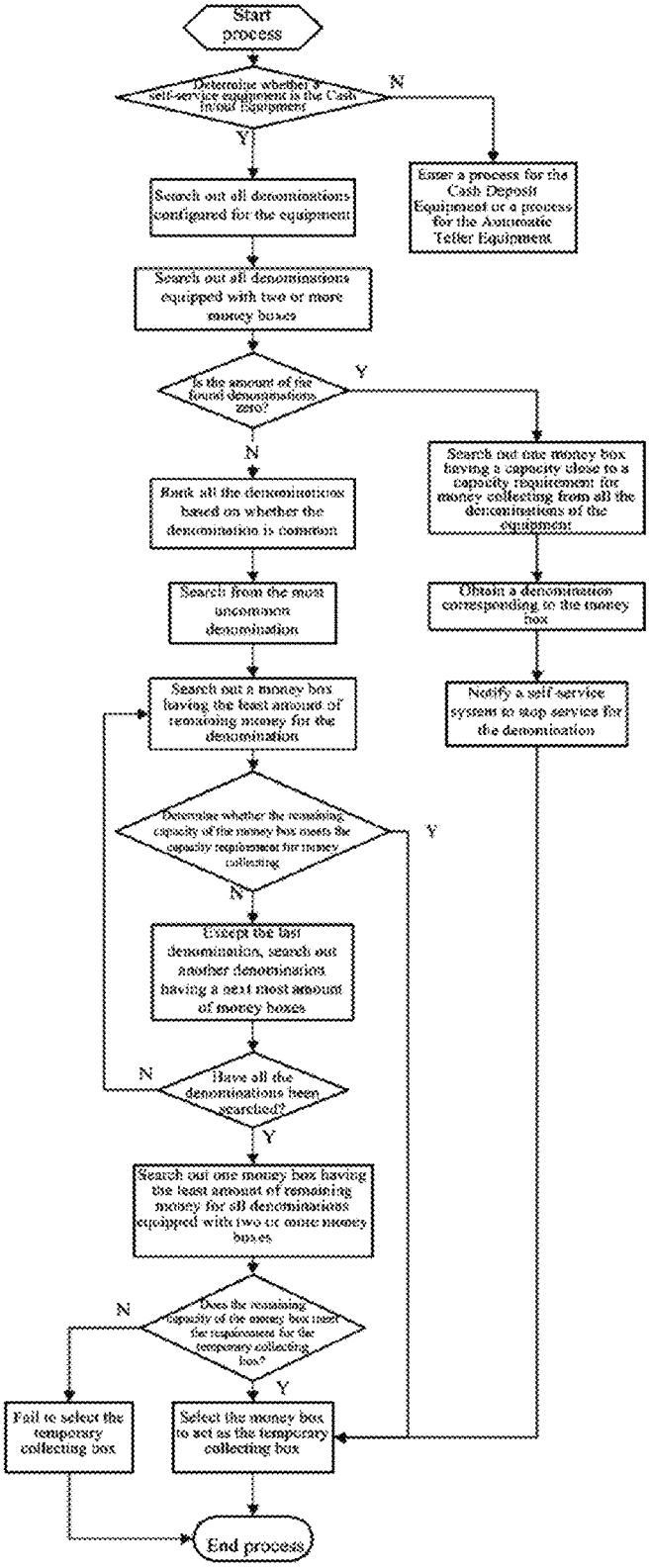
FIG. 2 is a flow chart of selecting a temporary collecting box in the case that the self-service equipment is a Cash In/out Equipment according to the present disclosure.

As shown in FIG. 2, in the case that the self-service equipment is the Cash In/out Equipment, the process of selecting the most appropriate functional money box as a temporary collecting box in step (2) includes steps (2a1) to (2a6):

(2a1) determining whether the self-service equipment is the Cash In/out Equipment, proceeding to step (2a2) if the self-service equipment is the Cash In/out Equipment; or else proceeding to a process of selecting the temporary collecting box for the Automatic Teller Equipment or the Cash Deposit Equipment;

(2a2) searching out all denominations wherein each denomination corresponding to an available money box among two or more money boxes for the denomination in the self-service equipment;

(2a3) ranking all denominations obtained in step (2a2) in an order from the most uncommon to the most common, based on whether the denomination is common;

(2a4) for a denomination list obtained in step (2a3), searching for a money box having the least amount of remaining money for each denomination in sequence in an order of a common coefficient of denomination from small to large, selecting a certain money box as the temporary collecting box as long as a remaining capacity of the money box meets a space requirement for the collecting box, and the process ending;

(2a5) in the case that the self-service equipment has no denomination corresponding to two or more money boxes for the denomination, that is, the equipment has only one available money box for each denomination capable of providing cash service, or for each money box having the least amount of remaining money for a denomination having one available money box among two or more money boxes for the denomination, its remaining capacity cannot meet the space requirement for the collecting box, in this case, searching for a money box based on the denominations each having only one available money box to act as the temporary collecting box; and (2a6) searching for all money boxes in sequence to search out a money box having the least amount of money, and determining whether the remaining capacity of the money box meets the space requirement for the collecting box, selecting the money box to act as the temporary collecting box and stopping cash service for the denomination if the remaining capacity of the money box meets the space requirement for the collecting box, and the process ending; or else the process of selecting the temporary collecting box fails, stopping the self-service, notifying a maintainer to clean and maintain the equipment, and the process ending.

Figure 3:
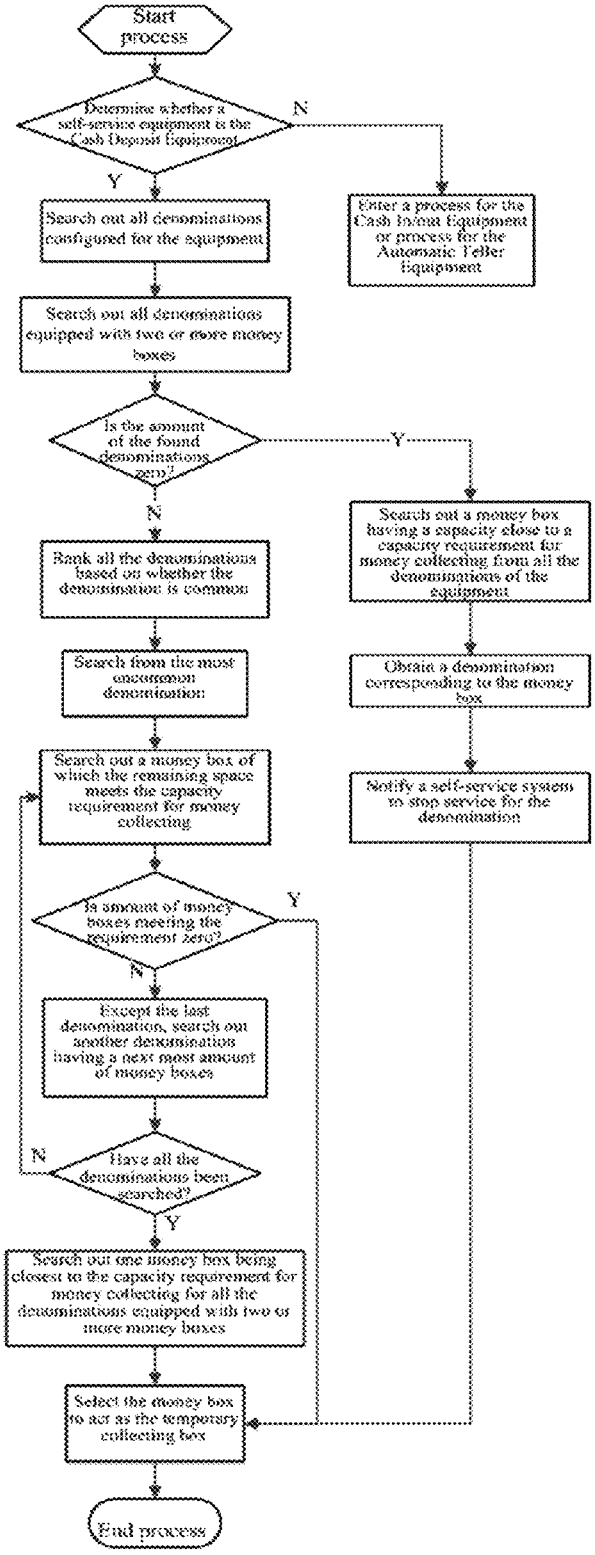
FIG. 3 is a flow chart of selecting a temporary collecting box in the case that the self-service equipment is a Cash Deposit Equipment according to the present disclosure.

As shown in FIG. 3, in the case that the self-service equipment is the Cash Deposit Equipment, the process of selecting an appropriate money box as a temporary collecting box includes steps (2b1) to (2b6):

(2b1) determining whether the self-service equipment is the Cash Deposit Equipment, proceeding to step (2b2) if the self-service equipment is the Cash Deposit Equipment; or else proceeding to a process of selecting the temporary collecting box for the Automatic Teller Equipment or the Cash In/out Equipment;

(2b2) searching out all denominations wherein each denomination has one available money box among two or more money boxes for the denomination in the self-service equipment;

(2b3) ranking all denominations obtained in step (2b2) in an order from the most uncommon to the most common, based on whether the denomination is common;

(2b4) for a denomination list obtained in step (2b3), searching for a money box closest to the space requirement for the collecting box for each denomination in sequence in an order of a common coefficient of denomination from small to large, selecting the money box to act as the temporary collecting box, and ending the process; in which as the Cash Deposit Equipment, the collected money is left by users at an In/Out port, there is no money to be collected in other cases.

(2b5) in the case that the self-service equipment has no denomination corresponding to two or more money boxes for the denomination, that is, the equipment has only one available money box for each denomination capable of providing cash service, or for each money box having the least amount of remaining money for a denomination having one available money box among two or more money boxes for the denomination, its remaining capacity cannot meet the space requirement for the collecting box, in this case, searching for a money box based on the denominations each having only one available money box to act as the temporary collecting box; and (2b6) searching for all money boxes in sequence to search out a money box being closest to the space requirement for the collecting box, selecting the money box to act as the temporary collecting box, and ending the process.

Figure 4:
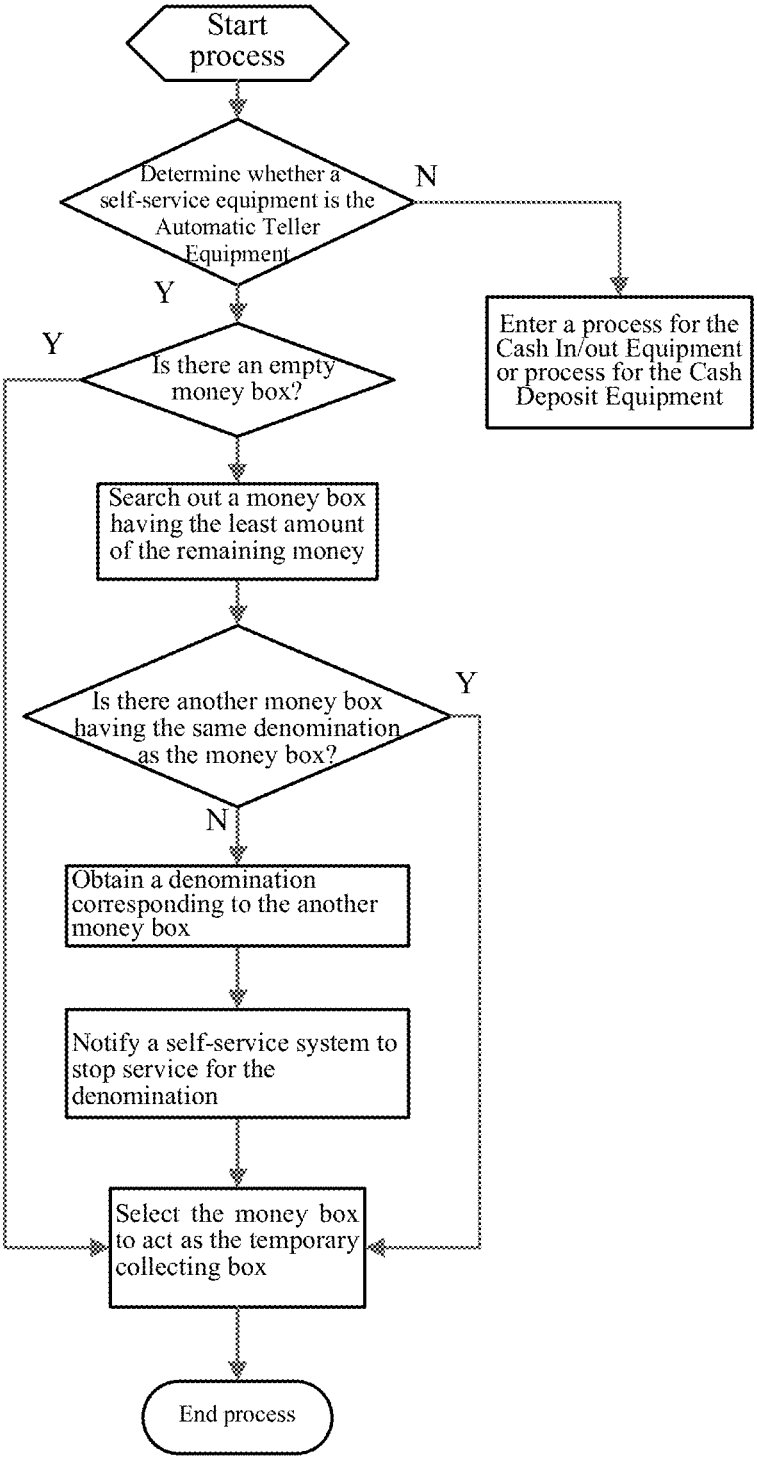
FIG. 4 is a flow chart of selecting a temporary collecting box in the case that the self-service equipment is an Automatic Teller Equipment according to the present disclosure.

As shown in FIG. 4, in the case that the self-service equipment is the Automatic Teller Equipment, the process of selecting the most appropriate functional money box as a temporary collecting box includes steps (2c1) to (2c4):

(2c1) determining whether the self-service equipment is the Automatic Teller Equipment, proceeding to step (2c2) if the self-service equipment is the Automatic Teller Equipment; or else proceeding to a process of selecting the temporary collecting box for the Cash In/out Equipment or the Cash Deposit Equipment;

(2c2) determining whether any one of the money boxes of the self-service equipment is empty, selecting the money box to act as the temporary box if there is the empty money box in the self-service equipment, and ending the process; or else proceeding to step (2c3), in which as the Automatic Teller Equipment, the empty money box is inoperable during this adding cash period and has enough space to act as the temporary collecting box, therefore, the empty money box is optimum.

(2c3) searching for a money box having the least amount of the remaining money, due to that the money box having the least amount of the remaining money has bigger space and can act as the temporary collecting box with minimum cost; and (2c4) determining whether there is another available money box having the same denomination as the searched money box having the least amount of the remaining money, selecting the another money box to act as the temporary money box if there is another available money box having the same denomination as the searched money box having the least amount of the remaining money, and ending the process; or else, stopping the cash service for the denomination corresponding to the money box, selecting the money box to act as the temporary money box and ending the process.

Furthermore, separating normal money in the money box is performed in step (3), the following two solutions may be adopted.

(31) The normal money in the money box is moved into other functional money boxes having the same denomination as the money box, and all money in the money box is drawn into another functional money box having the same denomination. The preferable process includes:

(311) acquiring denomination configuration of the money box;

(312) searching for whether there is other money boxes having the same denomination as the money box in other functional money boxes, proceeding to step (313) if there is other money box having the same denomination as the money box in the other functional money boxes; or else, ending the process, and adopting the solution of retaining the normal money in the money box in step (32);

(313) searching for one functional money box having the least amount of the remaining money in other money boxes having the same denomination as the money box;

(314) starting a movement to draw money in the money box, and moving the money into the functional money box having the least amount of the remaining money;

(315) in the case that the functional money box having the least amount of the remaining money becomes full and all normal money in the money box are not completely drawn, proceeding to step (313); or else, ending the process, and emptying the money box to act as the temporary money box; and (316) when other functional money boxes having the same denomination as the money box become full and all normal money in the money box are not completely drawn, ending the process, and still adopting the process of retaining the normal money in the money box in step (32).

Alternatively, the following solution is adopted: retaining the normal money in the money box as in step (32), separating the normal money in the money box by using a hardware device, such that the collected money is separated from the normal money after the money box is taken as the temporary money box, and it is convenient for the maintainer to clear and maintain the money box. The preferable process includes:

(321) designing a separation device in the money box, in which the separation device is configured to separate the normal money from the collected undetermined money, and it is convenient for the maintainer to clear and maintain the money box;

(322) moving the separation device to a respective position, and pushing all normal money to the back part of the money box, releasing the front space of the money box for accommodating the collected money once the money box is taken as the temporary collecting box; and (323) storing an amount of the normal money in the money box, labeling the money box as the temporary collection box and informing an upper service system.

Figure 5:
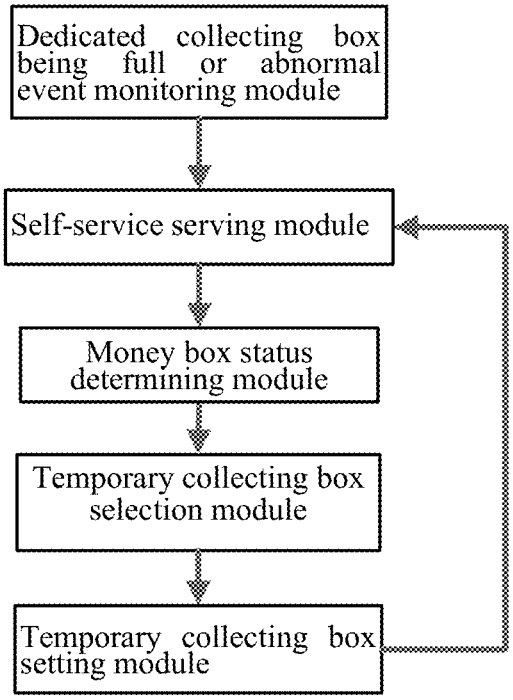
FIG. 5 is a block diagram of a system for outputting and collecting money applied to self-service equipment according to the present disclosure.

As shown in FIG. 5, the system for outputting and collecting money applied to self-service equipment according to the present disclosure includes a self-service serving module, a dedicated collecting box being full or an abnormal event monitoring module, a money box status determining module, a temporary collecting box selection module, and a temporary collecting box setting module.

The self-service serving module is configured to provide software and hardware devices for the self-service.

The dedicated collecting box being full or abnormal event monitoring module is configured to learn the event that the money box dedicated to collect money becomes full or fails to perform money collecting continuously in time and report the event to the self-service serving module in the case. In this case, the cash service of the self-service service cannot be performed continuously. The above mentioned money collecting by self-service includes: a) the money failing to pass a verification module in outputting money process of the self-service equipment; and b) the money left by users at an outputting port and automatically collected by the equipment.

The money box status determining module is configured to determine whether a money box is full or empty, or whether money is too less. The money box cannot receive money continuously in the case that the money box is full; money cannot be output from the money box in the case that the money box is empty; it needs to notify the maintainer to add money in the case that the money box status is low and money is too less.

The temporary collecting box selection module is configured to search for an appropriate functional money box to act as the temporary collection box in the case that the dedicated collection box is full or fails.

The temporary collecting box setting module is configured to set a functional money box to act as the temporary collection box for accommodating the collected money in the case that the dedicated collection box is full or fails. Therefore, in a subsequent self-service process, the dedicated collecting box is shielded and quits the self-service, and the functional money box acts as the collecting box for collecting the collected money.

The operation process of the system for outputting and collecting money applied to self-service equipment according to the present disclosure is as follows.

(1) The dedicated collecting box being full or abnormal event monitoring module transmits an event signal to the self-service serving module once it is found that the dedicated collecting box fails to service normally, and the self-service serving module suspends the cash service. That is, money depositing and withdrawing service cannot be performed continuously until another money box is found to act as the temporary collecting box.

(2) The self-service serving module notifies the money box status determining module to determine the status of all money boxes in the self-service equipment and select a money box having a normal money box status (except a money box having stuck money) to act as an alternative money box for the temporary collecting box.

(3) The temporary collecting box selection module selects a money box of which the remaining space meets the space requirement for the collecting box based on a type of the self-service equipment and a preset selection policy according to preceding description of the present disclosure.

(4) The temporary collecting setting module performs setting to the selected money box, separates the normal money in the money box, and sets the functional money box as the temporary collection box for accommodating the collected money in the subsequent self-service cash service; the temporary collecting box setting module sets the selected money box as the temporary collecting box, makes the dedicated collecting box quit the self-service, and transmits an event to notify the self-service serving module upon completion of the setting.

(5) The self-service serving module provides the cash service again and uses the temporary collecting box to accommodate the collected money in serving process.

The invention claimed is:

1. A method for outputting and collecting money applied to self-service equipment, wherein money boxes of the self-service equipment have two statuses comprising a functional status and a collecting status; under the functional status, the money box performs a general function of storing money in a common situation; and when a collecting box becomes full or abnormal, a certain one of the money boxes is selected and switched from the functional status to the collecting status to act as a temporary collecting box;

wherein when there is an empty money box of the self-service equipment or a certain money box of the self-service equipment has a small amount of money, the money box is selected and set to enter the collecting status to act as the temporary collecting box; in the case that normal money exists in the money box acting as the temporary collecting box, automatic isolation is performed, that is, the normal money in the money box is retained in the money box, the normal money is isolated into a back end part of the money box by using a physical device, and a front end part is separated for accommodating collected money and waste money; or all money in the money box is removed and stored into a money box for money of the same denomination, and the money box is spared to act as the temporary collecting box.

2. A method for outputting and collecting money applied to self-service equipment, comprising the following sequential steps:

(1) stopping temporarily a function of normal self-service cash service when a dedicated collecting box and a waste money box become full;

(2) selecting an appropriate money box from all functional money boxes to act as a collecting box;

(3) proceeding to step (4) in the case that the selected money box is empty, or separating normal money in the case that the normal money exists in the selected money box;

(4) labeling the selected money box as the collecting box and notifying an upper service software;

(5) configuring the selected money box to be a temporary collecting box; and (6) restoring the function of normal self-service cash service, and performing money collecting processing in the self-service process by using the temporary collecting box.

3. The method for outputting and collecting money applied to self-service equipment according to claim 2, wherein the process of selecting an appropriate money box to act as a temporary collecting box in step (2) comprises: firstly, determining whether the self-service equipment is a Cash In/out Equipment, an Automatic Teller Equipment or a Cash Deposit Equipment, and then selecting a most appropriate money box to act as the temporary collecting box based on the obtained type of the self-service equipment.

4. The method for outputting and collecting money applied to self-service equipment according to claim 3, wherein in the case that the self-service equipment is the Cash In/out Equipment, the process of selecting the most appropriate functional money box as a temporary collecting box in step (2) comprises:

(2a1) determining whether the self-service equipment is the Cash In/out Equipment, proceeding to step (2a2) if the self-service equipment is the Cash In/out Equipment; or else, proceeding to a process of selecting the temporary collecting box for the Automatic Teller Equipment or the Cash Deposit Equipment;

(2a2) searching out all denominations wherein each denomination corresponding to an available money box among two or more money boxes for the denomination in the self-service equipment;

(2a3) ranking all denominations obtained in step (2a2) in an order from the most uncommon to the most common, based on whether the denomination is common;

(2a4) for a denomination list obtained in step (2a3), searching for a money box having the least amount of remaining money for each denomination in sequence in an order of a common coefficient of denomination from small to large, selecting a certain money box as the temporary collecting box as long as a remaining capacity of the money box meets a space requirement for the collecting box, and the process ending;

(2a5) in the case that the self-service equipment has no denomination corresponding to two or more money boxes for the denomination, that is, the equipment has only one available money box for each denomination capable of providing cash service, or for each money box having the least amount of remaining money for a denomination having one available money box among two or more money boxes for the denomination, its remaining capacity can not meet the space requirement for the collecting box, in this case, searching for a money box based on the denominations each having only one available money box to act as the temporary collecting box; and (2a6) searching for all money boxes in sequence to search out a money box having the least amount of money, and determining whether the remaining capacity of the money box meets the space requirement for the collecting box, selecting the money box to act as the temporary collecting box and stopping cash service for the denomination if the remaining capacity of the money box meets the space requirement for the collecting box, and the process ending; or else the process of selecting the temporary collecting box fails, stopping the self-service, notifying a maintainer to clean and maintain the equipment, and the process ending.

5. The method for outputting and collecting money applied to self-service equipment according to claim 3, wherein in the case that the self-service equipment is the Cash Deposit Equipment, the process of selecting an appropriate money box as a temporary collecting box in step (2) comprises:

(2b1) determining whether the self-service equipment is the Cash Deposit Equipment, proceeding to step (2b2) if the self-service equipment is the Cash Deposit Equipment; or else proceeding to a process of selecting the temporary collecting box for the Automatic Teller Equipment or the Cash In/out Equipment;

(2b2) searching out all denominations wherein each denomination has one available money box among two or more money boxes for the denomination in the self-service equipment;

(2b3) ranking all denominations obtained in step (2b2) in an order from the most uncommon to the most common, based on whether the denomination is common;

(2b4) for a denomination list obtained in step (2b3), searching for a money box being closest to the space requirement for the collecting box for each denomination in sequence in an order of a common coefficient of denomination from small to large, selecting the money box to act as the temporary collecting box, and ending the process;

(2b5) in the case that the self-service equipment has no denomination corresponding to two or more money boxes for the denomination, that is, the equipment has only one available money box for each denomination capable of providing cash service, or for each money box having the least amount of remaining money for a denomination having one available money box among two or more money boxes for the denomination, its remaining capacity can not meet the space requirement for the collecting box, in this case, searching for a money box based on the denominations each having only one available money box to act as the temporary collecting box; and (2b6) searching for all money boxes in sequence to search out a money box being closest to the space requirement for the collecting box, selecting the money box to act as the temporary collecting box, and ending the process.

6. The method for outputting and collecting money applied to self-service equipment according to claim 3, wherein in the case that the self-service equipment is Automatic Teller Equipment, the process of selecting the most appropriate functional money box as a temporary collecting box in step (2) comprises:

(2c1) determining whether the self-service equipment is the Automatic Teller Equipment, proceeding to step (2c2) if the self-service equipment is the Automatic Teller Equipment; or else proceeding to a process of selecting the temporary collecting box for the Cash In/out Equipment or the Cash Deposit Equipment;

(2c2) determining whether there is an empty money box in the self-service equipment, selecting the money box to act as the temporary box if there is the empty money box in the self-service equipment, and ending the process; or else proceeding to step (2c3);

(2c3) searching for a money box having the least amount of the remaining money; and (2c4) determining whether there is another available money box having the same denomination as the searched money box having the least amount of the remaining money, selecting the money box to act as the temporary money box if there is another available money box having the same denomination as the searched money box having the least amount of the remaining money, and ending the process; or else, stopping the cash service for the denomination corresponding to the money box, selecting the money box to act as the temporary money box and ending the process.

7. The method for outputting and collecting money applied to self-service equipment according to claim 2, wherein the method for separating normal money in the money box in step (3) comprises:

(31) moving the normal money in the money box into other functional money boxes for the same denomination as the money box, and drawing all money in the money box into another functional money box for the same denomination as the money box; or

(32) retaining the normal money in the money box, separating the normal money in the money box by using a hardware device, wherein the collected money is separated from the normal money after the money box is taken as the temporary money box, and it is convenient for the maintainer to clear and maintain the money box.

8. The method for outputting and collecting money applied to self-service equipment according to claim 7, wherein the process of moving the normal money in the money box into other functional money boxes for the same denomination as the money box in step (31) comprises:

(311) acquiring denomination configuration of the money box;

(312) searching for whether there is other money box having the same denomination as the money box in other functional money boxes, proceeding to step (313) if there is other money box having the same denomination as the money box in the other functional money boxes; or else, ending the process, and adopting the solution of retaining the normal money in the money box in the money box in step (32);

(313) searching for one functional money box having the least amount of the remaining money in other money boxes having the same denomination as the money box;

(314) starting a movement to draw money in the money box, and moving the money into the functional money box having the least amount of the remaining money;

(315) in the case that the functional money box having the least amount of the remaining money becomes full and all normal money in the money box are not still drawn, proceeding to step (313); or else, ending the process, and emptying the money box to act as the temporary money box; and (316) when other functional money boxes for the same denomination as the money box become full and all normal money in the money box are not completely drawn, ending the process ending, and still adopting the process of retaining the normal money in the money box as step (32);

the process of the normal money in the money box being retained in this money box in step (32) comprises:

(321) designing a separation device in the money box, the separation device for separating the normal money from the collected undetermined money;

(322) moving the separation device to a respective position, and pushing all normal money to the back part of the money box, releasing the front space of the money box for accommodating the collected money once the money box is taken as the temporary collecting box; and (323) storing an amount of the normal money in the money box, labeling the money box as the temporary collecting box and informing an upper service system.

9. A system for outputting and collecting money applied to self-service equipment, comprising:

(1) a self-service serving module, configured to provide software and hardware devices for the self-service;

(2) a dedicated collecting box being full or abnormal event monitoring module, configured to learn an event that a dedicated collecting box is full or fails in time and report the event to the self-service serving module;

(3) a money box status determining module, configured to determine whether a money box is full or empty, or whether money is too less;

(4) a temporary collecting box selection module, configured to search for an appropriate money box to act as a temporary collecting box in the case that the dedicated collecting box is full or fails; and (5) a temporary collecting box setting module, configured to set a money box to act as the temporary collecting box for accommodating collected money in the case that the dedicated collecting box is full or fails, wherein the dedicated collecting box being full or abnormal event monitoring module transmits an event signal to the self-service serving module once it is found that the dedicated collecting box fails to service normally, and the self-service serving module suspends the cash service; the self-service serving module notifies the money box status determining module to determine the status of each functional money box and a money box of which the remaining space meets the space requirement for the collecting box is selected to act as the temporary collecting box among all money boxes in the self-service equipment except a money box having stuck money based on a type of the self-service equipment and a preset selection policy; the temporary collecting setting module performs a setting of temporary collecting box on the selected money box, separates the normal money in the money box, and sets the functional money box as the temporary collecting box for accommodating the collected money in the subsequent self-service cash service; the temporary collecting box setting module sets the selected money box as the temporary collecting box, makes the dedicated collecting box quit the self-service, and transmits an event to notify the self-service serving module upon completion of the setting; and the self-service serving module provides the cash service again, and uses the temporary collecting box to accommodate the collected money in service.

* * * * *